United States Patent [19]

Watanabe

[11] Patent Number: 4,769,669

[45] Date of Patent: Sep. 6, 1988

[54] IMAGE FORMING APPARATUS WITH MULTIPLE DRIVING MEANS

[75] Inventor: Junji Watanabe, Yokohama, Japan

[73] Assignee: Kabushiki Kaisha Toshiba, Kawasaki, Japan

[21] Appl. No.: 3,141

[22] Filed: Jan. 14, 1987

[30] Foreign Application Priority Data

Jan. 30, 1986 [JP] Japan ..... 61-18701

[51] Int. Cl.[4] ..... G03G 15/24

[52] U.S. Cl. ..... 355/3 R; 355/3 DD; 355/3 FU; 355/30; 355/133

[58] Field of Search ..... 355/3 R, 30, 3 FU, 14 FU, 355/133, 15, 8, 14 R, 3 DD, 14 D; 118/644, 645, 652; 219/216

[56] References Cited

U.S. PATENT DOCUMENTS

| | | | |
|---|---|---|---|
| T940,022 | 11/1975 | Rodda | 355/3 R |
| 3,049,968 | 8/1962 | Johanson | 355/3 R |
| 3,352,218 | 11/1967 | Ostensen | 355/3 R |
| 3,405,682 | 10/1968 | King et al. | 355/15 |
| 3,506,347 | 4/1970 | Carlson | 355/3 R |
| 4,303,334 | 12/1981 | Haupt et al. | 355/14 FU |
| 4,595,279 | 6/1986 | Kuru et al. | 355/14 FU |

FOREIGN PATENT DOCUMENTS

| | | | |
|---|---|---|---|
| 0104969 | 6/1982 | Japan | 355/15 |

*Primary Examiner*—Arthur T. Grimley
*Assistant Examiner*—John G. Smith
*Attorney, Agent, or Firm*—Oblon, Fisher, Spivak, McClelland & Maier

[57] ABSTRACT

An image forming apparatus includes a photosensitive drum, an exposure lamp included in an optical system for illuminating a document to form an exposed image on the photosensitive drum, a developer having a developing roller for developing the exposed image into a visible image on the photosensitive drum, a transfer charger for transferring the visible image onto a paper, a fixing roller for fixing the visible image transferred onto the paper, and a fan for exhausting the heat generated by the exposure lamp in the optical system to the outside. Further, the image forming apparatus includes a first driving mechanism for driving the developing roller of the developer and the fan, and a second driving mechanism for driving the photosensitive drum and the fixing roller.

13 Claims, 3 Drawing Sheets

IMAGE FORMING APPARATUS WITH MULTIPLE DRIVING MEANS

BACKGROUND OF THE INVENTION

1. Field of the Invention

The present invention relates to an image forming apparatus of which drive system for the internal components is improved.

2. Description of the Related Art

FIG. 1 shows a conventional copying apparatus as image forming apparatus. This copying apparatus scans the document using a carriage which is operated by a motor 1. The reflected light forms an image on a photosensitive drum 10 via first to third mirrors 3, 4 and 5, and a lens unit 6 and then fourth to sixth mirrors 7, 8 and 9. The surface of photosensitive drum 10 is uniformly charged by a main charger 11 and an electrostatic latent image is formed from the above-mentioned reflected image. Development of this electrostatic latent image is carried out in color or black by upper and lower developers 12 and 13 to obtain a visible image. The visible image on photosensitive drum 10 is transferred by a transfer charger 14 onto a paper fed from paper supply cassette 45 or 46. After being separated by a separation charger 15, the paper is transported to a fixing roller 17, where the image is fixed, via a transporting belt 16. After fixing, it is discharged by a exit roller 18.

By the rotation of a fan 19, the heat generated in the optical system is exhausted to the outside.

Fan 19, upper and lower developers 12 and 13, photosensitive drum 10 and fixing roller 17 are driven by double-shafted drive motor 21. That is, photosensitive drum 10 is connected to one shaft of drive motor 21 via a pulley 21*a*, a double-sided toothed belt 22, a pulley 23, gears 24 and 25, a pulley 26, a belt 27 and a pulley 28. Also, a developing roller 13*a* of lower developer 13 is connected to double-sided toothed belt 22 through a pulley 29, gears 30 and 31, and a developing roller 12*a* of upper developer 12 is also connected to gear 30 via gears 32, 33 and 34. Moreover, a roller 16*a* of transporting belt 16 is connected to double-sided toothed belt 22 via a pulley 35, gears 36, 37, 38 and 39. Furthermore, fixing roller 17 is connected to gear 38 via gears 40 and 41. Also, exit roller 18 is connected to gear 41 via gears 42, 43 and 44.

Fan 19 is connected to the other shaft of drive motor 21.

By the action of drive motor 21, fan 19 is rotated, and at the same time, double-sided toothed belt 22 is driven so that photosensitive drum 10, developing rollers 12*a* and 13*a* of developers 12 and 13, roller 16*a* of transporting belt 16, fixing roller 17 and exit roller 18 are respectively rotated.

However, in above-mentioned conventional copying apparatus, fan 19, developers 12 and 13, fixing roller 17 and photosensitive drum 10 have been driven by a single drive motor 21, various disadvantages have arisen because these these components could only be driven at the same speed. For example, when forming enlarged images or when color developing using upper developer 12, it is necessary to rotate photosensitive drum 10 at slow speed in order to ensure sufficient light in the former case, or from the viewpoint of the toner characteristic in the latter case. However, if this is done, fan 19 and developers 12 and 13 are also driven at slow speed. This has the disadvantages that cooling efficiency is reduced because fan 19 can not obtain sufficient air capacity. Also, developers 12 and 13 can not carry out good developing because the toner density of developing agent can not be controlled accurately.

SUMMARY OF THE INVENTION

It is an object of the present invention to provide an image forming apparatus in which, even if an image carrier is driven at slow speed, the air capacity of a fan will not be reduced and, at the same time, the speed of rotation of a developer will not be reduced.

According to one aspect of the present invention, the image forming apparatus comprises:

means for carrying an image formed thereon;

means for illuminating a document to form an exposed image on the carrying means;

means for converting the exposed image to a visible image on the carrying means;

means for transferring the visible image onto a paper;

means for fixing the visible image transferred on the paper;

means for exhausting foreign matter in the apparatus to the outside;

first means for driving the converting means and exhausting means; and second means for driving the carrying means and fixing means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 2 and 3 show an embodiment of an image forming apparatus according to the present invention, in which:

FIG. 2 is a schematic construction view showing the drive system of a copying apparatus; and FIG. 3 is a schematic construction view showing the arrangement of the image forming components the copying apparatus shown in FIG. 2.

DETAILED DESCRIPTION OF THE PREFERRED EMBODIMENTS

The present invention will now be described in detail with reference to the accompanying FIGS. 1 and 2.

Figure 1:
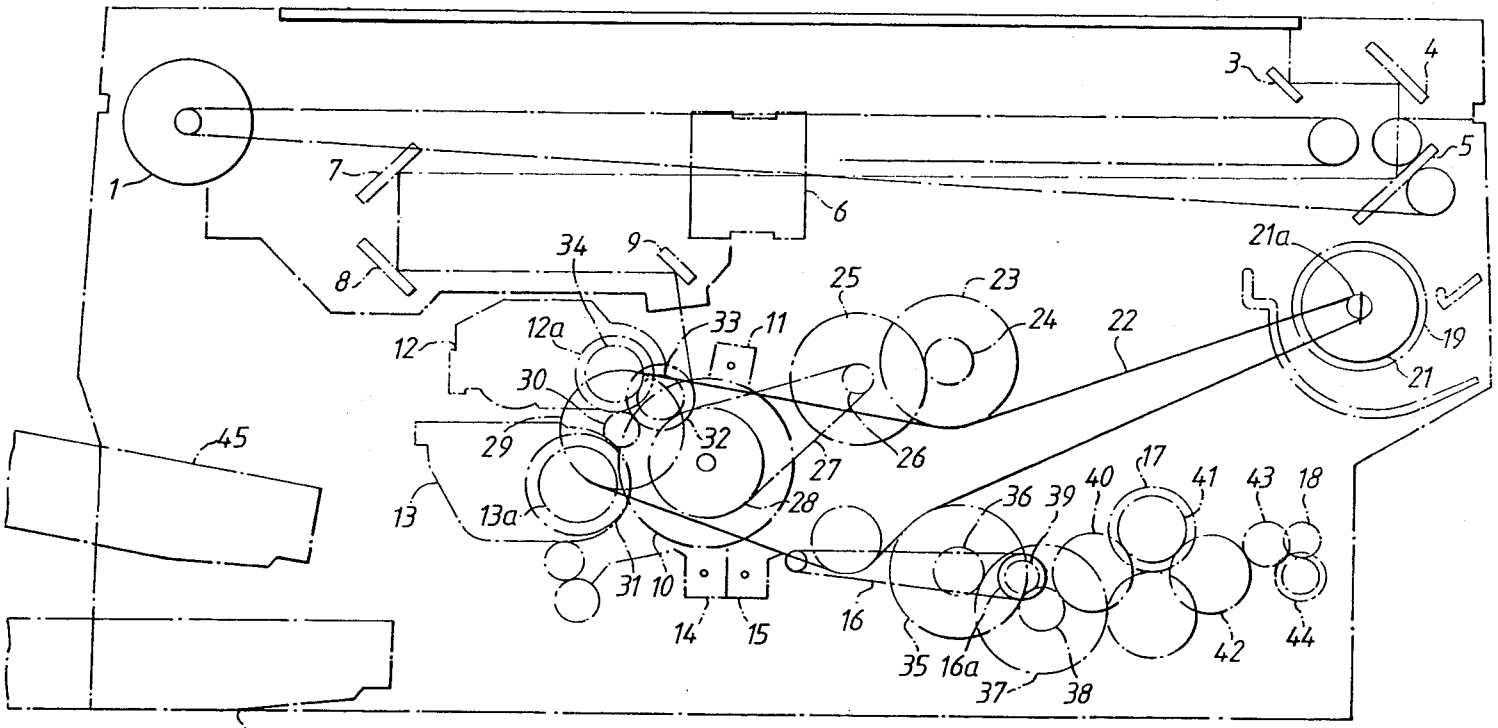
FIG. 1 is a schematic construction view showing the drive system of a conventional copying apparatus.
Figure 2:
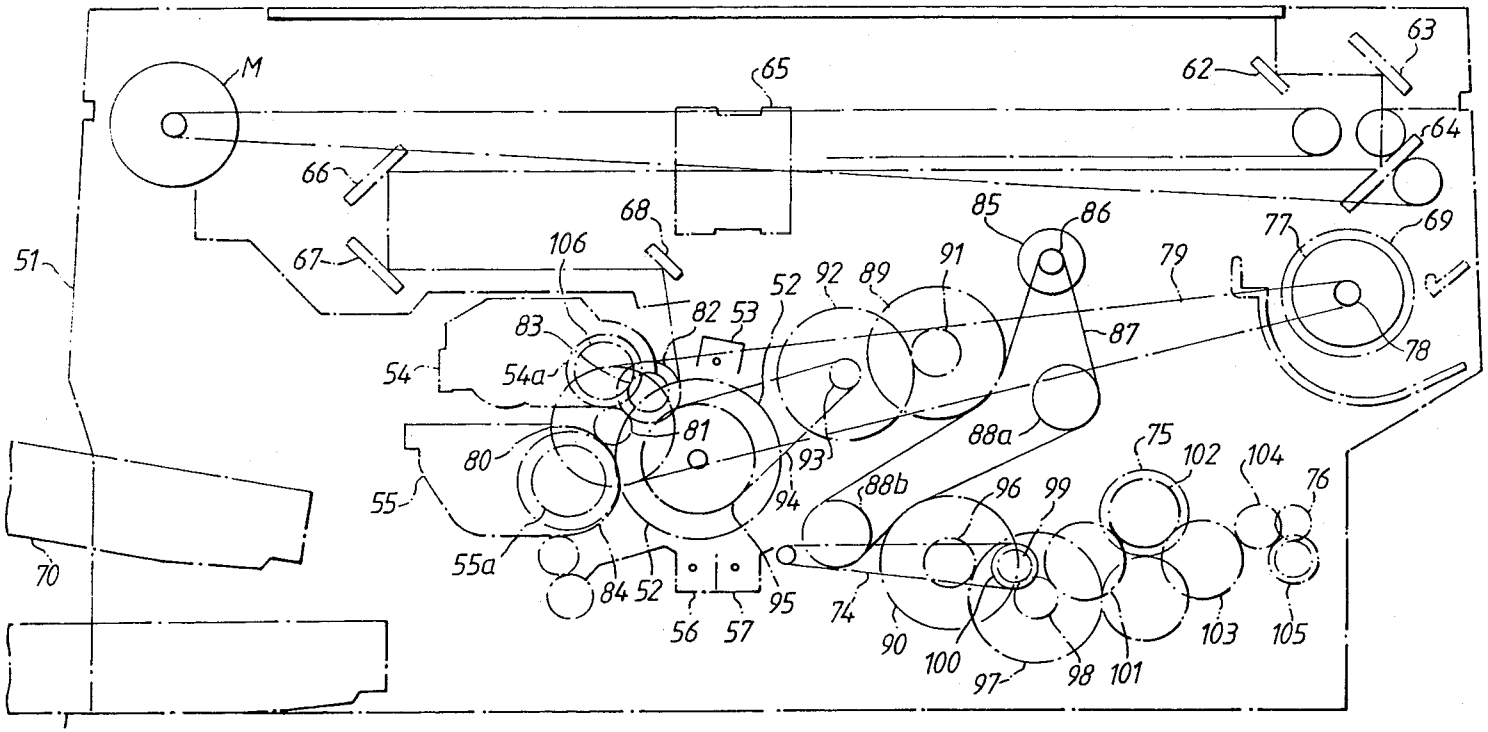

Referring now to FIGS. 1 and 2, there is shown an embodiment of a copying apparatus as an image forming apparatus. In FIG. 1, a rotatable photosensitive drum 52 which acts as the image carrier is installed near the center of a housing 51. A main charger 53, an upper developer 54 for color developing, a lower developer 55 for black developing, a transfer charger 56, a separation charger 57, a cleaning unit 58 and a discharge lamp 59 are installed around the periphery of photosensitive drum 52 in order in the direction of rotation. Also, optical system 60 is installed in the upper part of housing 51. Optical system 60 comprises an exposure lamp 61, a first mirror 62, a second mirror 63, a third mirror 64, a lens unit 65, a fourth mirror 66, a fifth mirror 67 and a sixth mirror 68. A fan 69 is installed near the inside wall of housing 51 for cooling optical system 60. Fan 69 exhausts the heat generated by exposure lamp 61 in optical system 60 to the outside of housing 51. Further, fan 69 also exhausts the other foreign matter, e.g., the toner leaked from developers 54 and 55, the heat generated by fixing roller 75, or the ozone generated by chargers 53, 56 and 57.

Upper and lower paper supply cassettes 70 and 71 are arranged in the lower part of housing 51, and paper is fed selectively from these cassettes. The paper supplied is transported along a transporting path 72. Along the route of this transporting path 72 are arranged, in order in the direction of travel, an aligning roller 73, transfer charger 56, separation charger 57, a transporting belt 74, a fixing roller 75 and a exit roller 76. A receiving tray 107 is mounted at out side wall of housing 51 for receiving the paper discharged by discharging roller 76.

Next, the driving system of this copying apparatus is explained with reference to FIG. 2. A double-shafted motor 77 is used as a first drive source. A pulley 78 is mounted on one shaft of double-shafted motor 77, and fan 69 is mounted on the other shaft. A pulley 80 for driving the developer roller is connected to pulley 78 of double-shafted motor 77 via a belt 79. A gear 81 is mounted coaxially on pulley 80. A gear 82 engages with gear 81. A gear 83 is mounted coaxially on gear 82. A gear 84 of a developing roller **55*a* of lower developer station 55 selectively engages with gear 81. A gear 106 of developing roller 54*a* of upper developer 54 selectively engages with gear 83**.

On the other hand, a motor 85 is used as a second drive source. Idler rollers **88*a* and 88*b* are connected to a pulley 86 of motor 85 via a double-sided toothed belt 87. A pulley 89 and a pulley 90 respectively engage with double-sided toothed belt 87 which runs round idler rollers 88*a* and 88*b*. A gear 91 is mounted coaxially on pulley 89. Photosensitive drum 52 is connected to gear 91 via a gear 92 engaged with gear 91, a pulley 93 mounted coaxially on gear 92, a belt 94 rounded with pulley 93 and a pulley 95**.

Also, a roller 100 of transporting belt 74 is connected to pulley 90 via a gear 96, a gear 97 engaged with gear 96, a gear 98 mounted coaxially on gear 97, and a gear 99 engaged with gear 98. Roller 100 is mounted coaxially on gear 99. Moreover, a gear 102 of fixing roller 75 is connected to gear 98 via a gear 101, and a gear 105 of exit roller 76 is connected to gear 102 via gears 103 and 104.

Further, paper supply rollers not shown are disposed on paper supply cassettes 70 and 71 respectively. These paper supply rollers are selectively driven by a motor not shown to supply a paper from cassette 70 or 71.

Figure 3:
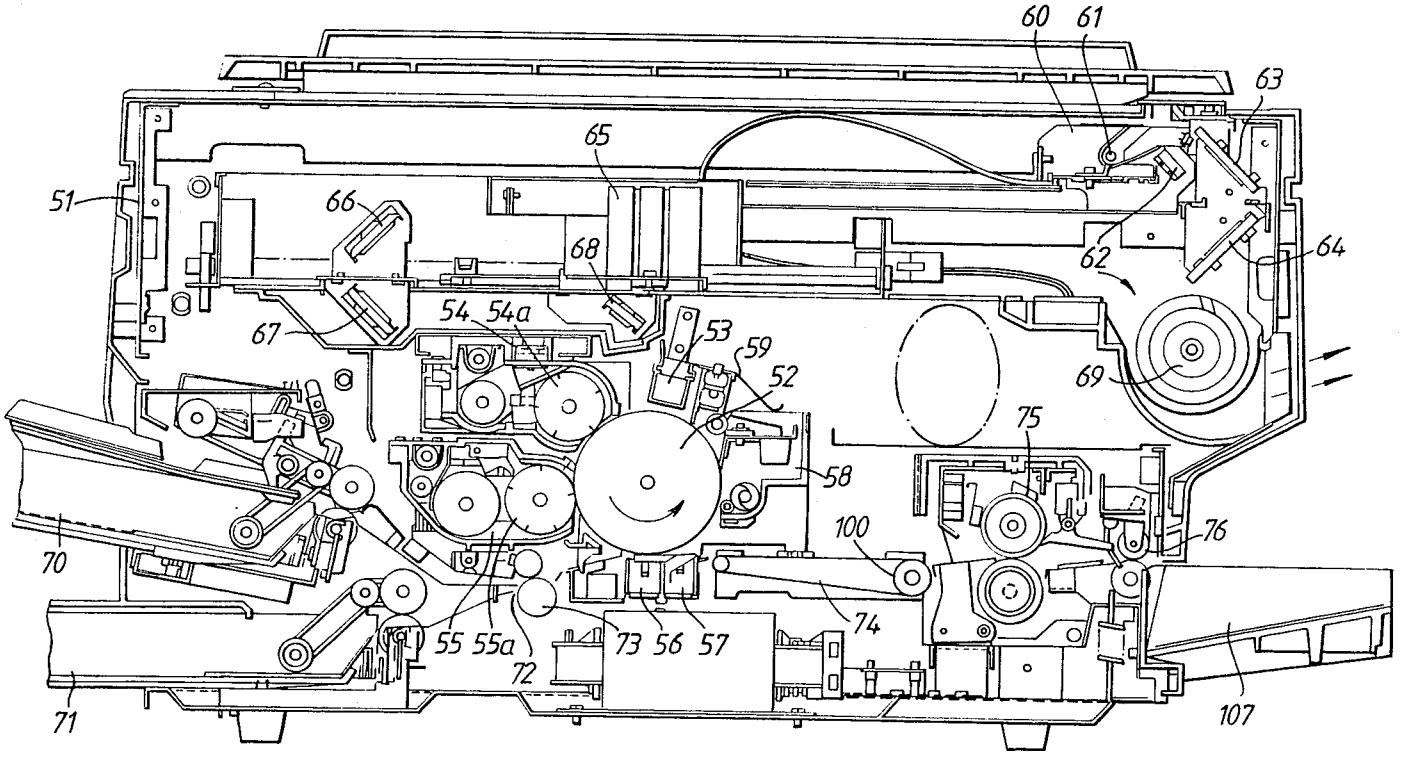

With respect to FIG. 3, when an image is formed, the document is illuminated with light by exposure lamp 61 and, at the same time, exposure lamp 61 is moved by the action of a motor M and is thus scanned. The light reflected from the document passes via first to third mirrors 62, 63 and 64 moved by motor M and fixed lens unit 65 and then via fixed fourth to sixth mirrors 66, 67 and 68 to form an image on photosensitive drum 52. The surface of photosensitive drum 52 is uniformly charged by main charger 53 and an electrostatic latent image is formed by above-mentioned scanning operation. Photosensitive drum 52 is rotated by the action of second motor 85 via double-sided toothed belt 87, pulley 89, gears 91 and 92, pulley 93, belt 94 and pulley 95 and the electrostatic latent image is brought to upper and lower developers 54 and 55. Upper and lower developers 54 and 55 are selectively shifted by a mechanism not shown. Gear 106 of developing roller **54*a* in upper developer 54 engages with gear 82, and gear 84 of developing roller 55*a* in lower developer 55 engages with gear 81. Gear 81 is rotated by the action of first motor 77 via belt 79 and pulley 80. By this means developing roller 54*a* or 55*a* is rotated, the developing agent is supplied and developing is accomplished to obtain a visible image on photosensitive drum 52. Moreover, fan 69 is rotated by the action of first motor 77 and optical system 60** is cooled.

On the other hand, the visible image is transferred by transfer charger 56 on to paper supplied from paper supply cassette 70 or 71. Then it is separated by separation charger 57 and transported to transporting belt 74. Tranporting belt 74 is operated by roller 100 which is rotated by the action of second motor 85 via double-sided toothed belt 87, pulley 90 and gears 96, 97, 98 and 99, and transports the paper. Then, fixing roller 75 is rotated via gears 98, 101 and 102. Exit roller 76 is rotated via gears 103, 104 and 105. After the image has been fixed by fixing roller 75, the paper is discharged to receiving tray 107 by exit roller 76.

When an image is formed by enlargement or when color developing is carried out using upper developer 54, the speed of rotation of second drive motor 85 is reduced. By this means, photosensitive drum 52 is rotated at slow speed and obtains a sufficient amount of light, and, at the same time, it can respond to the characteristic of the developing agent for color developing and good color developing can be achieved.

As described above, fan 69 and developers 54 and 55 are driven by first motor 77 independently of photosensitive drum 52 and fixing roller 75, which are driven by second motor 85. Therefore, when enlarging images or when color developing, even if photosensitive drum 52 and fixing roller 75 are rotated at slow speed, the speed of rotation of fan 69 and developers 54 and 55 will not be reduced. Thus, the cooling eficiency of optical system 60 can be maintained and, at the same time, good developing can be achieved.

Further, if developing roller **55*a* of developer 55 is rotated at high speed by motor 77 as the first drive source for obtaining a good image quality, the toner of developing agent is liable to be scattered with a great deal of force in housing 51. However, since fan 69 is also rotated at high speed by motor 77, fan 69 can exhausts completely the scattered toner to the outside of housing 51**.

Furthermore, when the photosensitive drum 52 is rotated at a slow speed by the motor 85, as the second drive source, the amount of toner, forming the visible image transferred onto a paper from photosensitve drum 52 is increased. Therefore, a high heat quantity is required to fix the transferred visible image on the paper. However, since the fixing roller 75 is also rotated at slow speed by motor 85, the paper can make contact with the fixing roller 75 for a long time resulting in a good fixing of the visible image on the paper.

What is claimed as new and desired to be secured by Letters Patent of the United States is:

1. An image forming apparatus comprising:

means for carrying an image formed thereon;

means for illuminating a document to form an exposed image on said carrying means;

means for converting exposed image to a visible image on said carrying means;

means for transferring said visible image onto a paper;

means for fixing said visible image transferred on said paper;

means for exhausting foreign matter in the apparatus to the outside;

first driving means for driving said converting means and exhausting means; and second driving means for driving said carrying means and said fixing means.

2. An image forming apparatus according to claim 1, wherein said carrying means includes a photosensitive drum.

3. An image forming apparatus according to claim 2, wherein said illuminating means includes a lamp.

4. An image forming apparatus according to claim 3, wherein said converting means comprises:

a developer having a developing roller.

5. An image forming apparatus according to claim 4, wherein said transferring means includes a transfer charger.

6. An image forming apparatus according to claim 5, wherein said fixing means includes a fixing roller.

7. An image forming apparatus according to claim 6, wherein said exhausting means includes a fan.

8. An image forming apparatus according to claim 7, wherein said first driving means for driving said converting and exhausting means comprises:

a double-shafted motor having first and second shafts; and means for communicating the rotation force generated by said motor to said developing roller via said first shaft and to said fan via said second shaft.

9. An image forming apparatus according to claim 8, wherein said communicating means comprises:

a first pulley mounted on said first shaft;

a second pulley;

a belt coupling said first and second pulleys;

a first gear mounted coaxially on said second pulley;

a second gear engaged with said first gear; and a third gear mounted coaxially on said second gear and engaged with said developing roller.

10. An image forming apparatus according to claim 8, wherein said developer comprises:

a first developer having a first developing roller for color developing and a second developer having a second developing roller for black developing and said communicating means includes;

a first pulley mounted on said first shaft;

a second pulley;

a belt coupling first and second pulleys;

a first gear mounted coaxially on said second pulley;

a second gear engaged with said first gear;

a third gear mounted coaxially on said second gear;

a fourth gear connected to said first developing roller and selectively engaged with said third gear; and a fifth gear connected to said second developing roller and selectively engaged with said first gear.

11. An image forming apparatus according to claim 7, wherein said second driving means comprises:

a motor; and second means for communicating the rotational force generated by said motor to said photosensitive drum and to said fixing roller.

12. An image forming apparatus according to claim 11, wherein said second communicating means comprises:

a first pulley mounted on said motor;

an idler roller;

a toothed belt coupling said first pulley and said idler roller;

a second pulley engaged with said toothed belt;

a first gear mounted coaxially on said second pulley;

a second gear engaged with said first gear;

a third pulley mounted coaxially on said second gear;

a fourth pulley connected to said photosensitive drum;

a belt coupling said third and fourth pulleys;

a fifth pulley engaged with said toothed belt;

a third gear mounted coaxially on said fifth pulley; and a fourth gear engaged with said third gear and connected to said fixing roller.

13. An image forming apparatus according to claim 1, further comprising:

means for discharging said paper to the outside and said second driving means further drives said discharging means.

* * * * *